US005653643A

United States Patent [19]

Falone et al.

[11] Patent Number: 5,653,643

[45] Date of Patent: Aug. 5, 1997

[54] VIBRATION ABSORBING MATERIAL FOR HANDLES OF SPORTING EQUIPMENT

[75] Inventors: Thomas Falone, Mickleton, N.J.; Richard S. Wyerman, Doylestown; Carmen Dimario, West Chester, both of Pa.

[73] Assignee: Pendulum Corp., Media, Pa.

[21] Appl. No.: 560,699

[22] Filed: Nov. 20, 1995

[51] Int. Cl.[6] ..... A63B 53/14

[52] U.S. Cl. ..... 473/300; 473/332; 473/318; 473/523

[58] Field of Search ..... 473/300, 301, 473/302, 326, 324, 428, 303, 332, 318; 273/75

[56] References Cited

U.S. PATENT DOCUMENTS

| | | | |
|---|---|---|---|
| 1,125,029 | 1/1915 | Laro | 473/300 |
| 1,620,118 | 3/1927 | Mattern | 473/300 |
| 3,606,326 | 9/1971 | Sparks | 473/300 |
| 4,591,160 | 5/1986 | Piragino | 473/326 |
| 4,613,537 | 9/1986 | Krupper | 428/337 |
| 5,254,391 | 10/1993 | Davis | 428/68 |
| 5,261,665 | 11/1993 | Downey | 473/303 |
| 5,333,861 | 8/1994 | Mills | 473/329 |

*Primary Examiner*—Sebastiano Passaniti
*Assistant Examiner*—Stephen L. Blau
*Attorney, Agent, or Firm*—Connolly & Hutz

[57] ABSTRACT

Various tools and devices, such as golf clubs, are improved by the incorporation of a vibration absorbing material having a hardness of less than 40 durometer reading, a coefficient of friction of at least 0.6 and a dampening vibration greater than 55%. When used for a golf club the material can be incorporated in the handle part of the shaft to improve the grip, can be inserted down the inside of the shaft to increase vibration absorption and a more solid contact or can be incorporated in the club head.

11 Claims, 2 Drawing Sheets

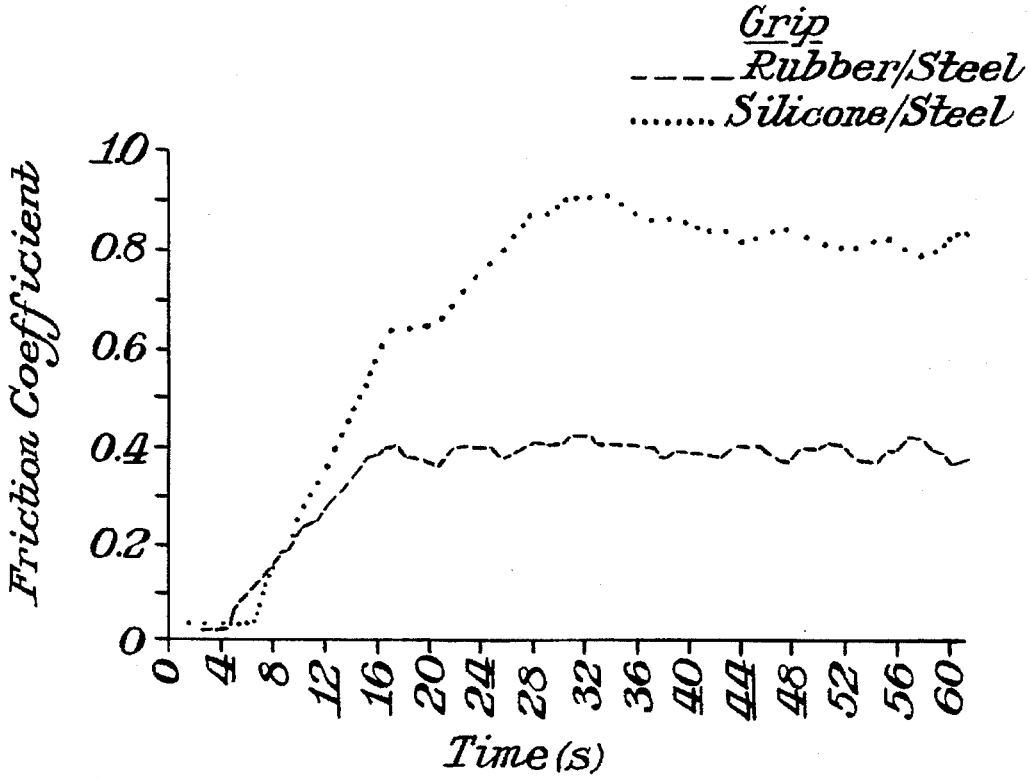
Fig. 10.
Fig. 11.
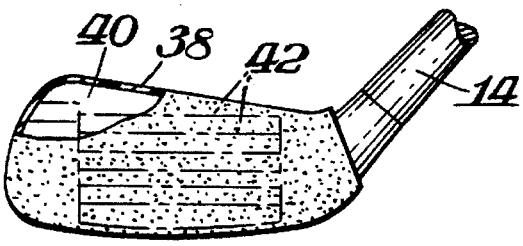
Fig. 12.
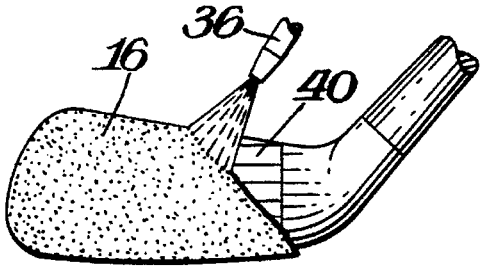

VIBRATION ABSORBING MATERIAL FOR HANDLES OF SPORTING EQUIPMENT

BACKGROUND OF THE INVENTION

Various devices exist for various fields wherein it would be desirable to dampen the vibration of the device while in use. A particular need for such a device is with regard to the handle portions which are squeezed during use of the device. Such handles may be incorporated in sporting equipment, such as golf clubs, bats, racquets and the like. The need for such improvement, however, is also with devices where there is a gripping action required in the simple use of the device such as in the holding of various tools. This need is particularly acute where users may have medical problems such as arthritic conditions making it difficult to squeeze a handle.

SUMMARY OF THE INVENTION

An object of this invention is to incorporate a vibration absorbing material in various types of devices to improve the use of such devices either in terms of performance and/or end ease of use.

A further object of this invention is to provide such a material which could be included in athletic equipment, particularly in the handle portions of such athletic equipment.

A still further object of this invention is to improve the performance and ease of use of golf clubs.

In accordance with this invention the vibration absorbing material is provided having a hardness of less than 40 durometer reading and a coefficient of friction of at least 0.6 with a dampening vibration of greater than 55%. The material may be incorporated as the gripping surface of a handle, particularly where the material is incorporated around the rigid inner core of the handle.

An important feature of the invention is the "increased friction" aspect of the product/material which allows for less gripping action or less grip pressure. This reduced grip pressure allows for less "operator" fatigue and in some instances, improved performance such as experienced by arthritic persons.

Where used as the gripping surface of a golf club improvement is enhanced by incorporating a rigid inner structure to support the gripping material. Such inner structure preferably has a plurality of spaced points and more preferably the inner structure is formed by spaced peaks and valleys which may be equally or randomly spaced to facilitate the application of the vibration absorbing material.

The vibration absorbing material may be applied by being molded on the device such as by being premolded or molded in situ. Alternatively, the vibration absorbing material could be in the form of a flexible tape which would be wrapped around the device. In another practice of the invention, the vibration absorbing material could be a preformed sleeve which would be slipped over the device.

THE DRAWINGS

FIG. 10 is a graph comparing the coefficient of friction of conventional rubber grips with a grip formed from the vibration absorbing material of this invention;

FIG. 11 is a side elevational view partially broken away of a golf club head utilizing the vibration absorbing material in the form of a sleeve; and FIG. 12 is a view similar to FIG. 11 showing application of the vibration absorbing material on the club head by being applied in situ.

DETAILED DESCRIPTION

The present invention is based upon the recognition that known materials, such as silicone sealants and various polymer, acrylic and modified rubber compounds, have physical characteristics which render them ideal for use as a vibration absorbing material to improve the performance and/or ease of use of various devices. Preferably, the vibration absorbing material is characterized by a hardness of less than 40 durometer reading from a Durometer Class D device and a coefficient of friction of at least 0.6 with a dampening of vibration of greater than 55% as derived from Accelerometer Testing using Lab Tech Software. Materials which have these characteristics include silicone sealants and similar type polymer, acrylic and modified rubber compounds. Reference is made to U.S. Pat. Nos. 4,483,972 and 4,417,042, the details of which are incorporated herein by reference thereto with regard to the composition of suitable materials.

Figure 1:
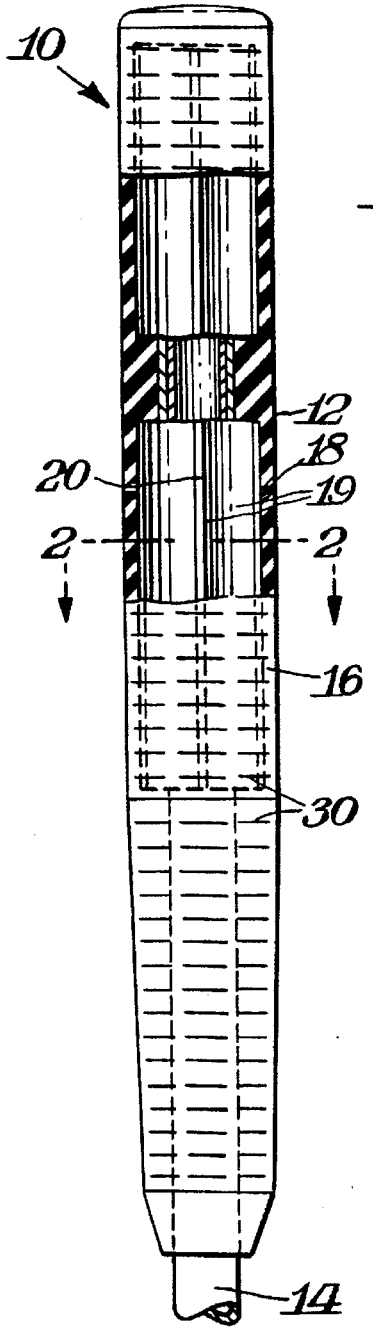
FIG. 1 is a side elevational view of a golf club shaft partially broken away illustrating the incorporation of a vibration absorbing material in accordance with this invention.
Figure 2:
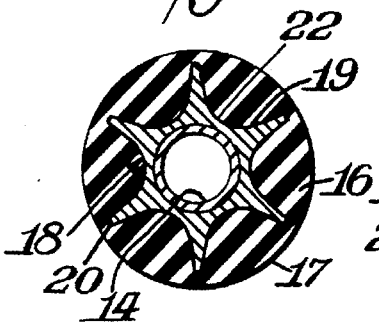
FIG. 2 is a cross-sectional view taken through FIG. 1 along the line 2—2.

A particularly advantageous use of the vibration absorbing material is as the gripping surface of a golf club. FIG. 1, for example, illustrates a golf club 10 which includes a shaft 12 terminating in the handle portion. Shaft 12 includes a rigid core 14. Vibration absorbing material 16 is mounted around the core. Preferably, as shown in FIGS. 1–2, a rigid inner support structure 18 is mounted around core 14 with the material 16 applied over the inner structure. The use of the inner structure provides stability, torque resistance and a vehicle to install the material 16. Preferably, the inner structure has a plurality of spaced projections and more preferably is in the form of peaks 20 and valleys 22 formed by longitudinal ribs 19. The peaks and valleys may be equally or randomly spaced. As a result, the material 16 does not have a uniform thickness, but rather is thicker in the valleys than it is at the peaks so as to result in a smooth outer surface. This is particularly necessary to comply with golf requirements for the grip to be generally circular in cross-section.

Figure 3:
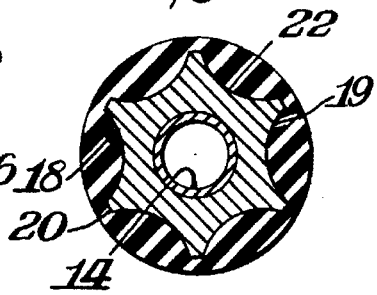
FIGS. 3–7 are cross-sectional views similar to FIG. 2 showing alternative structures in accordance with this invention.

FIGS. 1–2 illustrate the inner structure 18 to include the plurality of peaks 20 and valleys 22 to result from narrow ribs 19, while FIG. 3 shows the ribs to be thicker or more blunt. If desired, the peaks 20 may terminate at or slightly inwardly of the resulting circular outer surface 17 formed by the grip. In both FIGS. 2 and 3 there are 6 equally spaced peaks 20 with the inner structure being generally in a star shape. The provision of this number of peaks is desirable to achieve the best balance in results. It is to be understood, however, that a greater or lesser number of peaks may be utilized in accordance with the invention. The ability to vary the number of peaks and valleys provides a manner varying the degree of flex or torque. The ability to change the flex of the grip results from changing the thickness and/or number of peaks and valleys.

Figure 4:
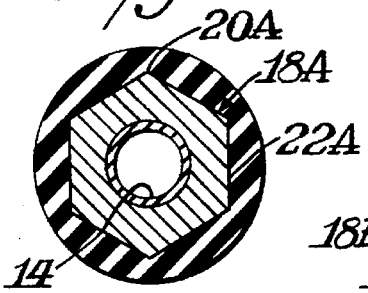

FIG. 4 illustrates a variation of the inner structure 18A wherein the inner structure 18A is formed as a hexagon having six peaks 20A interconnected by flat sides 22A.

Figure 5:
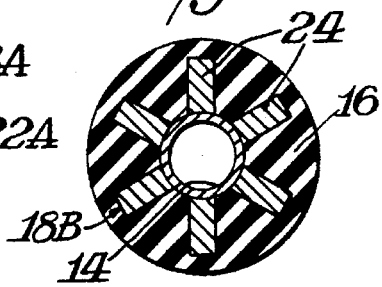

FIG. 5 shows yet another variation wherein the inner structure 18B is formed by a plurality of disconnected bars 24 so that valleys are formed between the bars, and the ends of the bars comprise the peaks. If desired bars 24 could be welded or molded to core 14.

Figure 6:
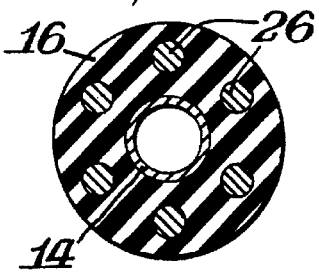

FIG. 6 shows yet another variation wherein the inner structure is formed by a plurality of spaced longitudinal rods 26 which are parallel to the axis of the core 14 and spaced from the core 14. This differs from FIG. 5 where the bars 24 extend radially from the core and may, although not necessarily, be in contact with the core 14.

Figure 7:
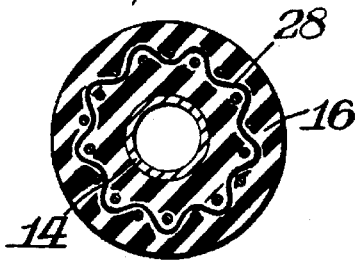

FIG. 7 illustrates a variation wherein the inner structure is provided by a mesh material 28 spaced from the core 14.

As shown in FIG. 1 the exterior surface 17 of the grip material 16 has spaced slits 30 to enhance the gripping action. The slits 30 are shown as extending transversely around the outer surface perpendicular to the longitudinal ribs 19. It is to be understood that the slits could be in any pattern, of any thickness and shape, and in any direction including (but not limited to) transverse, diagonal, circular, etc.

Figure 8:
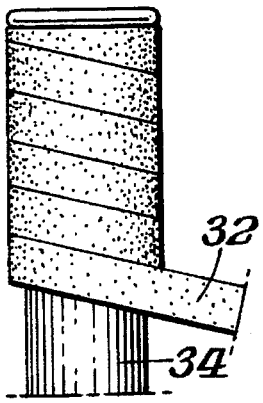
FIG. 8 is a side elevational view showing the application of the vibration absorbing material of this invention in the form of a wrap.

The grip 16 may be applied to the club shaft 12 in various manners. In one practice of the invention the grip 16 would be premolded by the manufacturer applying the material 16 directly on the inner structure 18. FIG. 8, however, illustrates an alternative wherein the material 16 is applied to a fiberglass mesh, such as mesh 28 to form a tacky tape 32 which would be around a handle 34. The material could also be applied to a tape or cloth or to itself. As illustrated in FIG. 8 the handle could be a racquet, fishing rod, bat, etc., rather than a golf club. The application techniques would depend on the sport (e.g. tennis, lacrosse, etc.)

Figure 9:
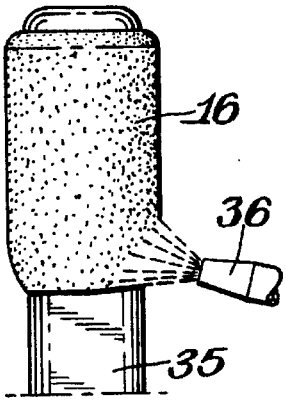
FIG. 9 is a view similar to FIG. 8 showing application of the vibration absorbing material in situ.

FIG. 9 illustrates the practice of the invention wherein the material 16 is applied in situ on the handle 35 of a hockey stick or racquet by, for example, spraying the components from a nozzle 36 where the components are in the form of a self-curing coating. Alternatively the coating may be applied by dipping, spreading, pouring, rolling, etc.

The grip resulting from this invention better conforms to the hand, allowing substantially reduced grip strength (pressure) and maximum absorption of vibration while complying with USGA rules. The grip resulting from material 16 has the following advantages:

1. VIBRATION ABSORPTION. The unique design and composition of material 16 in the grip absorb and disperse vibration, cushioning the jolt and tremor resulting from the club's impact upon the ball. The significance of this is fourfold: a) reduced fatigue in the hands and forearms, b) minimization of the vibration from agitating or creating tendinitis, c) reduced hesitation in anticipation of impact, and d) comfort for those with reduced grip strength (arthritis, age, etc.). Preliminary analysis by a prestigious engineering university reveals that there is almost ten times the amount of impact vibration dampening versus other golf grips.

2. REDUCED GRIP PRESSURE. The softness of the grip requires greatly reduced grip pressure to hold the club. In fact, over-gripping is actually met with increasing resistance by the grip and the hands are forced to relax to a lighter, optimum level of pressure. This ability of the grip enables the golfer to concentrate on the swing and approach rather than the amount of pressure being exerted by the right and left hands. The result: truer, straighter shots with greatly reduced slicing and hooking. Muscle tension was measured at over 20% less for the grip 16 versus other golf grips.

3. INCREASED CONTROL/DECREASED DISPERSION. The reduced grip pressure and muscle tension help to minimize or eliminate the "push-pull" effect between the left and right hands which is the one key cause of severe slicing and hooking. By reducing this effect, the swing motion follows a tighter line and shots are dispersed more evenly toward the center of the fairway. In an informal controlled study, a decrease of 17.6% to 22% in dispersion of shots was recorded versus that of other grips.

4. GREATER DISTANCE. Because the amount of grip pressure is reduced throughout the entire arc of swing, competing resistance is minimized and results in a more fluid, relaxed stroke and greater distance. An informal controlled study revealed a 13.2% increase in distance other than that of other grips.

5. GREATER TACKINESS & DURABILITY. The grip's silicone surface layer 17 is moderately tacky and non-porous which is water proof and dirt resistant. Even when wet, it remains non-slip. Other grips use either a semi-porous rubber material or a leather wrap, both of which retain moisture and dirt, have a greater degree of slippage/twist, and tend to disintegrate. The material can be varied in its degree of tackiness depending upon the use and desired result. Preferably the material relies on its friction, with varying degrees of tackiness.

6. LONGEVITY. The grip 16 utilizes an extremely durable silicone based coating over, for example, a rigid hexagon or six peak shaped star inter-skeleton. The result is a unique design which uses the maximum amount of vibration dampening without sacrificing vertical rigidity and twist resistance. The silicone coating is an all-weather blend which stands up to the harshest conditions. Other grips lose their tackiness and become hard, needing replacement within two or three years of normal use (for peak performance). The grip 16 expected to last up to ten years of normal use.

Characteristics of the grip 16 include the following:

Reduces grip pressure

- by relaxing the grip, motion is more natural, excessive grip pressure is automatically "calibrated" to find the proper/optimum level of resistance/force. In other words, the harder you squeeze the more it resists, enabling you to find the optimum amount of pressure;
- measurement of muscle tension vs. normal grip; durometer (friction) readings show normal grips range form 68.75–78.75 vs. the grip 16 at 0–10;
- "muscle focusing" vs. muscle memory; relaxed grip allows muscle to focus at the top and especially, the bottom of the swing, creating a "snap/whip like" movement;
- measurement of velocity (club head); reduced pressure allows muscles to focus on one function vs. two, minimizing cross-tension and improving speed and distance.

Dampens impact vibration

- comparison of the mount of impact vibration vs. a normal club;
- the amount of vibration from graphite vs. steel vs. aluminum. Graphite should be more due to whipping action with normal grips; with the grip 16 . . . ahout the same;
- reduces pain and agitation of arthritis and tendinitis resulting from impact with club head;
- reduces muscle fatigue resulting from vibration, over gripping.

Improves control relaxed grip reduces muscle tension, fatigue and "over-gripping" which are the leading causes of hooking, slicing and topping the ball;

test results shows that the dispersion of shots were narrowed by 17.6% to 22% versus a normal grip;

"directional flexibility" allow club to "square" itself at top and bottom of swing.

Better than air channels analogy to over/under inflated tires;

transfer of vibration vs. torque/twist tradeoff;

normal grips are comprised of the same materials as tires—hard wear resistant rubber.

Torque control normal grips have virtually zero torque and forgiveness, whereas the grip 16 allows for automatic adjustment for club head squaring; aerodynamics of club head are maximized;

improves and accentuates performance of shaft and club head.

Improves distance independent test showed an average 13.2% increase in distance, over 22 yards (w/drive);

relaxed grip and "club head squaring" enable a more fluid swing, increasing club head speed and impact, resulting in great distance.

Superior feel "tackiness"

The silicone soft tacky feel make it the easiest grip to hold;

stays tacky and soft in any condition-cold, hot, wet, dry;

feel, never let go, glue-like.

Superior wear characteristics normal grips parallel the composition of automobile tires, therefore their wear is fairly durable, however, their tendency is to dry out and become hard, thus needing replacement after 2–3 years. The grip 16 expected to stay soft for up to 15 years;

the cost to physically replace grips is expensive, ranging from \$5–\$10/grip or \$65–\$130 for a set of clubs. The cost of a conventional grip itself could range from \$1.10 to \$7.00, or \$14–\$91. Overall, the whole process can cost \$79 to \$221.

Replacement made simple

The grips 16 can be easily installed at home without any special expertise or equipment.

The advantages of the invention result from the characteristics of the vibration absorbing material 16. FIG. 10, for example, illustrates a comparison of the coefficient of material 16 which is labeled as silicone on steel, as compared to a conventional golf club grip of rubber on steel (Golf Pride Green Grip). As is apparent after a very short period of time the coefficient of friction with the material 16 was rated at 0.9 versus a conventional grip rated at 0.4. It is preferred to have a minimum coefficient of friction of 0.6 or greater.

The dampening of vibration varies widely depending on how the ball was hit, In tests, however, the dampening of vibration registers significantly higher at an average of 80% with the invention versus other grips at 30–40%. It is preferred that the material have a dampening of vibration of greater than 55%.

The hardness of the material 16 was measured from a durometer reading between the infrastructure ribs or fins at a resolution level of less than 10 in comparison to a standard grip (Golf Pride Green Victory Grip) at 80. The level measured at this point of the fins was estimated at 35. It is referred to have a hardness for the grip of less than 40.

The invention may also be practiced to improve the performance of a golf club by providing the vibration absorbing material as a filler within the hollow core 14 of shaft 12. This could be in addition to or instead of using the material as the grip.

In a further variation of the invention, the vibration absorbing material may form a cover for a club head. FIG. 11, for example, illustrates a preformed sleeve 38 over club head 40. In such practice of the invention the cover could come in three sizes to cover a putter or a driver/wood or an iron and wedge. In this practice of the invention the material 16 is located at the ball striking face of head 40. The material can also be applied to putters, hockey sticks, shoulder pads, etc. FIG. 11, for example, illustrates the ball striking face to include strike lines 42. Thus, in this embodiment of the invention the sleeve 40 could be made with the ball striking portion from material 16 and the remainder of the sleeve could be made from the same or other materials. Alternatively, the sleeve 40 could be formed by having a completely closed ball striking surface disposed at the face of head 38 while the rear portions of the surface are interconnected by straps or the rear surfaces otherwise have open areas.

FIG. 12 illustrates a further variation in the practice of the invention involving the application of the vibration absorbing material to a golf club head. As shown therein the material 16 could be applied by being sprayed or applied from nozzle 16 to the exterior surface of the club head or ball striking face. Alternatively, the application could be by dipping, spreading, pouring, rolling, etc. In this practice of the invention the material 16 could be applied completely around all surfaces of the club head or its application could be confined generally to the ball striking face.

The material could also be incorporated in the club head in other suitable manners such as being applied to a cavity based within the head or via slats, ridges, etc. on the club face as part of the manufacturing process.

Where the material is applied to the head there is a reduction of vibration on impact through the club which might otherwise affect the swing of the club. The application of the material to the club head may be in combination with the incorporation of the material 16 as the gripping surface of the handle and/or with the material being a filler for the shaft core.

While the invention has been particularly described with respect to improving the performance of golf clubs, the invention may also be utilized with other athletic equipment. The invention would incorporate many of the advantages that it has with golf clubs when used as the gripping portion on the handle of various athletic equipment. Such athletic equipment could include for example, various racquet sports, such as tennis and racquetball. In addition, the gripping surface may be utilized on athletic equipment in the form of bats or sticks, such as in baseball, lacrosse, hockey, cricket and fencing. The material could also be incorporated in athletic equipment involving the throwing of elongated objects which must be gripped such as javelins.

Advantages of the vibration absorbing material include the following:

Absorbs vibration,

Protects club head surface form dirt, scratches, moisture, etc.,

Increases club head's grip of ball during strike, especially when wet,

Can be either permanently molded into club bead via any means or as a removable slip on "boot or sock", Can include various sub-structures to serve a multitude of functions including, but not limited to, metal or graphite materials to increase distance, nylon or other material to prolong durability/wear, etc., Can be used with all club heads, and Can be any thickness.

What is claimed is:

1. In a hand held article of athletic equipment having an elongated handle with a gripping area having a gripping surface to be gripped by the user in a squeezing action, the improvement being in that said handle includes an inner core, a flexible vibration absorbing material around said inner core, said vibration absorbing material having an outer surface which comprises said gripping surface, said outer surface of said vibration absorbing material being non-porous and tacky, said vibration absorbing material having a hardness of less than 40 durometer reading, said vibration absorbing material having a coefficient of friction of at least 0.6, said vibration absorbing material having a dampening of vibration greater than 55%, an inner support structure around said inner core, said inner support structure having a plurality of spaced rigid projections extending longitudinally the length of said gripping area to provide lateral and longitudinal rigidity during the use of said article, said inner support structure being located inwardly of said outer surface of said vibration absorbing material, said vibration absorbing material and said inner support structure being secured together by said projections extending into said vibration absorbing material, said vibration absorbing material being distinct and separable from said inner support structure, and said vibration absorbing material completely covering said projections to render said outer surface of said vibration absorbing material as the sole user contacting and gripping surface in said gripping area during use of said article.

2. The device of claim 1 wherein said vibration absorbing material is in the form of a tape wrapped around said inner support structure.

3. The device of claim 2 wherein said tape is formed from a flexible mesh structure impregnated by said vibration absorbing material, and said vibration absorbing material being a silicone gel.

4. The device of claim 1 wherein said vibration absorbing material is a sleeve mounted around said inner support structure.

5. The device of claim 1 wherein said vibration absorbing material is molded around said inner support structure.

6. The device of claim 1 wherein said inner structure includes a plurality of spaced peaks and valleys, said peaks being said projections, and said material being of non-uniform thickness and having a smooth outer surface.

7. The device of claim 1 wherein there are greater than four projections.

8. The device of claim 7 wherein said inner structure is in the form of a six-peaked star.

9. The device of claim 1 wherein said inner structure comprises elongated bars or which are set projections.

10. The device of claim 1 wherein said article is a golf club.

11. The device of claim 1 wherein said handle is part of an article selected from the group consisting of golf clubs, javelins, racquets, sticks and bats.

* * * * *